US006347470B1

(12) United States Patent
Radovich

(10) Patent No.: US 6,347,470 B1
(45) Date of Patent: Feb. 19, 2002

(54) INFLATABLE DISPLAY FIGURE

(76) Inventor: JoAnn Radovich, 4698 Montrose Ave., Youngstown, OH (US) 44512

( * ) Notice: Subject to any disclaimer, the term of this patent is extended or adjusted under 35 U.S.C. 154(b) by 0 days.

(21) Appl. No.: 09/560,675

(22) Filed: Apr. 27, 2000

(51) Int. Cl.[7] ..... G09F 13/00
(52) U.S. Cl. ..... 40/610; 40/540; 446/226
(58) Field of Search ..... 40/610, 540; 446/226, 446/176, 178, 179

(56) References Cited

U.S. PATENT DOCUMENTS

| | | | | | |
|---|---|---|---|---|---|
| 2,748,256 | A | | 5/1956 | Moran | 362/362 |
| 3,234,685 | A | * | 2/1966 | Harrowe | 446/177 |
| 3,892,081 | A | | 7/1975 | Goral | 40/214 |
| 4,179,832 | A | | 12/1979 | Lemelson | 40/540 |
| 4,369,591 | A | | 1/1983 | Vicino | 40/610 |
| 4,837,958 | A | | 6/1989 | Radovich | 40/538 |
| 5,402,591 | A | | 4/1995 | Lee | 40/610 |
| 5,480,029 | A | * | 1/1996 | Batsford | 206/522 |
| 5,778,581 | A | * | 7/1998 | Bailey | 40/610 |
| 5,797,208 | A | * | 8/1998 | Lessa | 43/2 |
| 6,105,292 | A | * | 8/2000 | Current | 40/605 |
| 6,186,857 | B1 | * | 2/2001 | Gazit et al. | 446/226 |

* cited by examiner

*Primary Examiner*—William A. Cuchlinski, Jr.
*Assistant Examiner*—Marthe Y. Marc-Coleman
(74) *Attorney, Agent, or Firm*—Robert J. Herberger

(57) ABSTRACT

An inflatable indoor/outdoor three-dimensional display figure. It is made to be freestanding by using a base comprising an inflatable base portion and a pocket therebelow. A weight may be positioned in the pocket to further secure it in place for indoor use. For outdoor use the base has attached uninflated tabs around its perimeter. Using mounting fasteners that pass therethrough, the inflatable display figure can be mounted to the ground. The display figure may comprise fasteners for attaching an optional display area for a written message.

21 Claims, 8 Drawing Sheets

INFLATABLE DISPLAY FIGURE

FIELD OF THE INVENTION

This invention relates to an inflatable display figure comprising a message area and designed for indoor or outdoor uses. When used outdoors, it can be placed in the yard and securely anchored to the ground, and its design will also enable it to be free standing for indoor use.

BACKGROUND OF THE INVENTION

Heretofore, inflatable display figures have been designed with a weighted sand bottom or a compartment to add water making the inflatable display figures appear unbalanced. Other designs have a large piece of hard board built into the floor of the inflatable object. Art in the field is not directed to inflatable objects whose design enables it to be free standing and anchored to the ground without the added expense of a built-in weighted area. Also, none of the prior art has been designed to alleviate the inconvenience of adding water to its base for sturdy indoor use. A weighted base is not necessary for outdoor use, yet if this weighted base is built into the inflatable display, the consumer will be paying for the added expense of construction and shipping.

Many users would find it desirable to have an inflatable object which can be securely fastened to the ground for outdoor use, stand unsecured for indoor use and have a display area for messages. It is also desirable to eliminate the added cost of manufacturing and shipping for a weight integrated within the display figure.

SUMMARY OF THE INVENTION

The present invention satisfies the need for a display figure that can be securely fastened to the ground for outdoor use or stand unsecured for indoor use without using an inconvenient weight. The inflatable display figure comprises an upper inflatable portion having a base attached thereto. The base has an inflatable enclosure defined by a top layer and an inner layer. The display figure further comprises a pocket defined by the inner layer and a bottom layer, where the bottom layer has an opening for a weight.

Accordingly, the following are the objectives and advantages of the invention, which differs in construction, operation and results from the prior art articles and devices.

One objective is to provide an inflatable indoor/outdoor display figure which can be used in the celebration of holidays and special events such as birthdays, births and anniversaries.

Another objective is to provide an inflatable indoor/outdoor display figure which can be placed in the yard and able to withstand a reasonable amount of wind and weather.

Still, another objective is to provide an inflatable indoor/outdoor display figure which can be free standing for office, party or home use.

Another objective is to provide an inflatable indoor/outdoor display figure with an area for written messages.

Further, another objective of the present invention is to provide an inflatable indoor/outdoor display figure which is simple in construction and inexpensive to manufacture.

Another objective of the present invention is to provide an inflatable display figure which is attractive and eye-catching.

Still yet, another objective of the present invention is to provide an inflatable indoor/outdoor display figure which can be packed away with relative ease and using a small amount of space.

Finally, another objective is to provide an inflatable indoor/outdoor display figure in which the consumer is not paying for more than what they need.

BRIEF DESCRIPTION OF DRAWINGS

In view of the above and other such objects as may hereafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed. The figures listed below have been selected to illustrate a preferred embodiment of the present invention. These figures along with the accompanying description are sufficient for those skilled in the art to practice the invention as claimed.

DESCRIPTION OF THE PREFERRED EMBODIMENT

Figure 1:
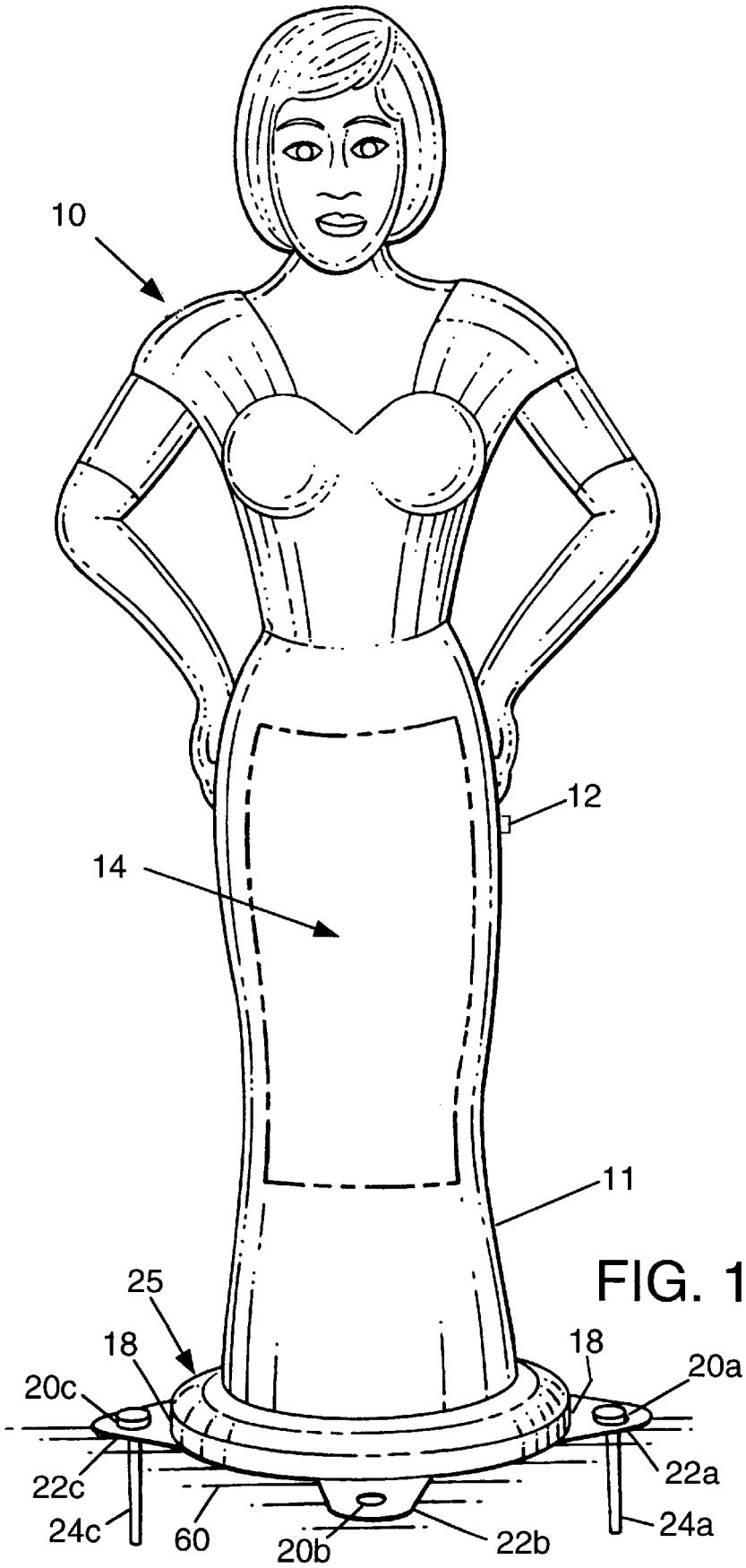
FIG. 1 is a front elevational view of an inflatable indoor/outdoor display figure in the form of a young lady in accordance with the present invention.
Figure 2:
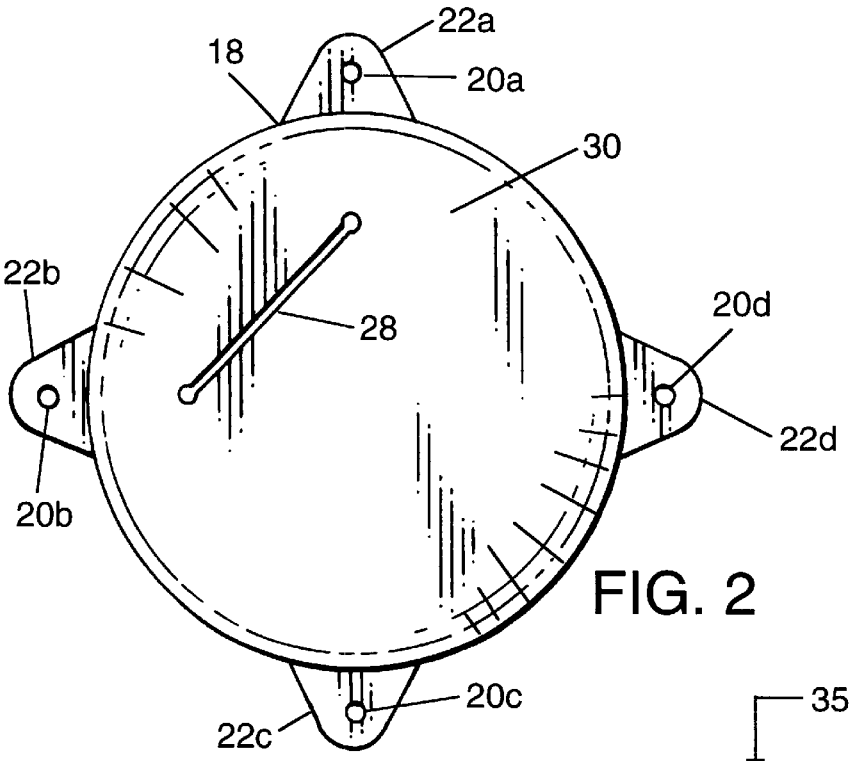
FIG. 2 is a bottom view of the base of the inflatable display figure.
Figure 3:
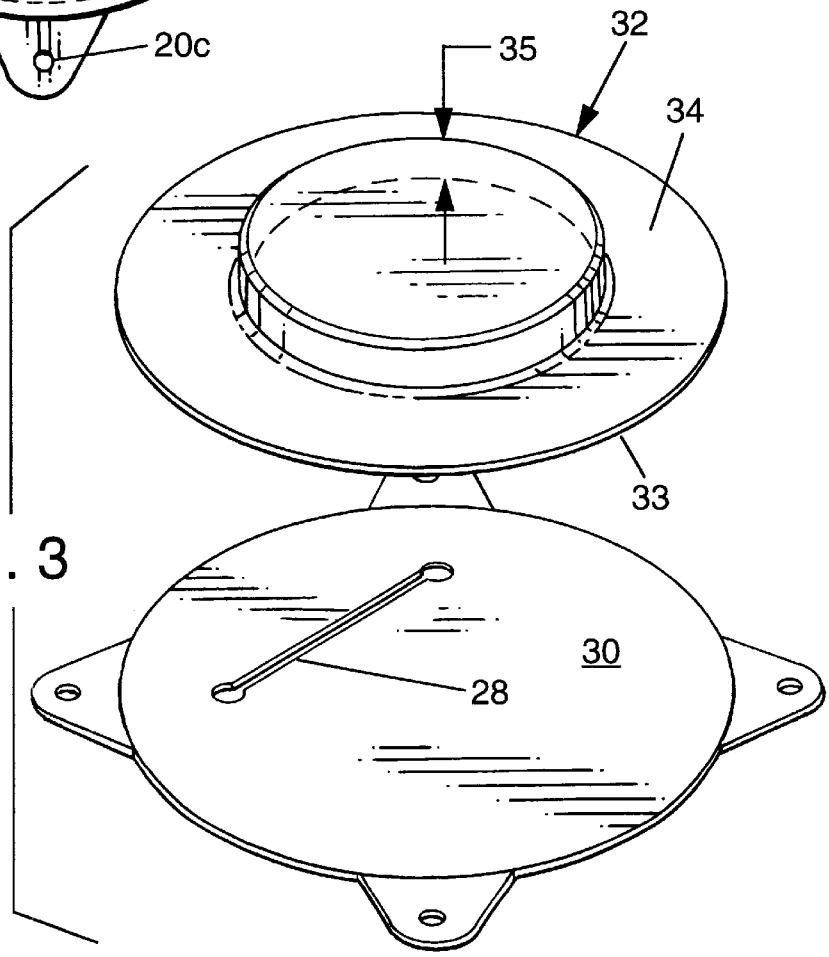
FIG. 3 is an exploded view showing the bottom, inner layer and I-beam parts.
Figure 4:
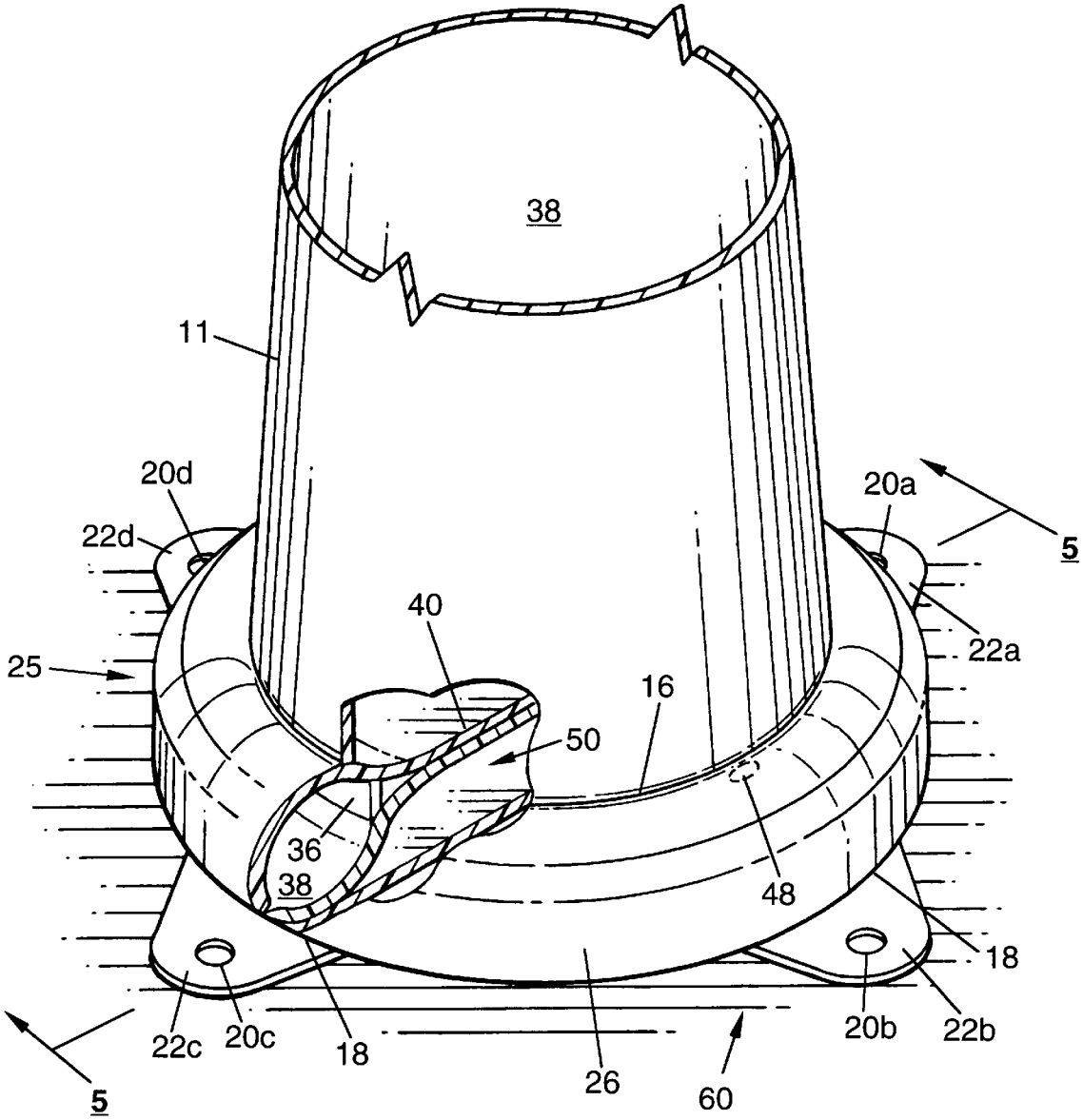
FIG. 4 is a partial cut-a-way perspective view showing the base and surrounding parts.

While the inflatable display object to be described is in the nature of a young lady, it should be evident that the present invention can be used in conjunction with any other type of inflatable figure. Referring specifically to the figures, identical or similar parts are designated by the same reference numerals throughout FIGS. 1–9. This invention satisfies the need for eliminating the burdensome base or weight of current inflatable display figures.

An inflatable display 10 comprises an upper inflatable portion 11 having a base 25 attached to the upper inflatable portion 11. The base 25 is comprised of three layers: a bottom layer 30, an inner layer 32 and a top layer 40. The top layer 40 and a topside 34 of the inner layer 32 comprise an inflatable base portion 26 of the base 25. The base 25 further comprises a pocket 50 defined by an underside 33 of the inner layer 32 and the bottom layer 30, where the bottom layer 30 has an opening 28 for a weight 52 to be placed in the pocket 50. The weight 52 can be any object that substantially maintains the base 25 in position, such as but not limited to, a book.

Figure 5:
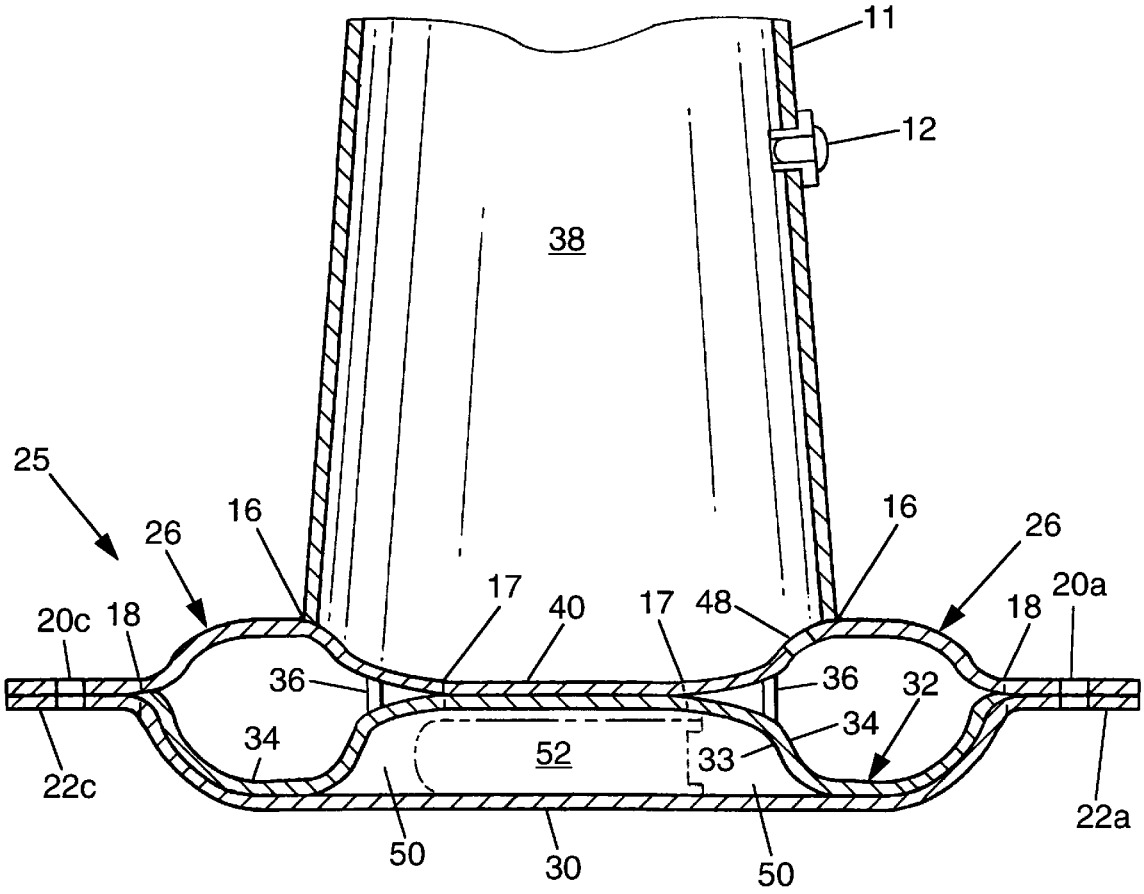
FIG. 5 is a sectional view thereof as taken through section 5—5 on FIG. 4.
Figure 6:
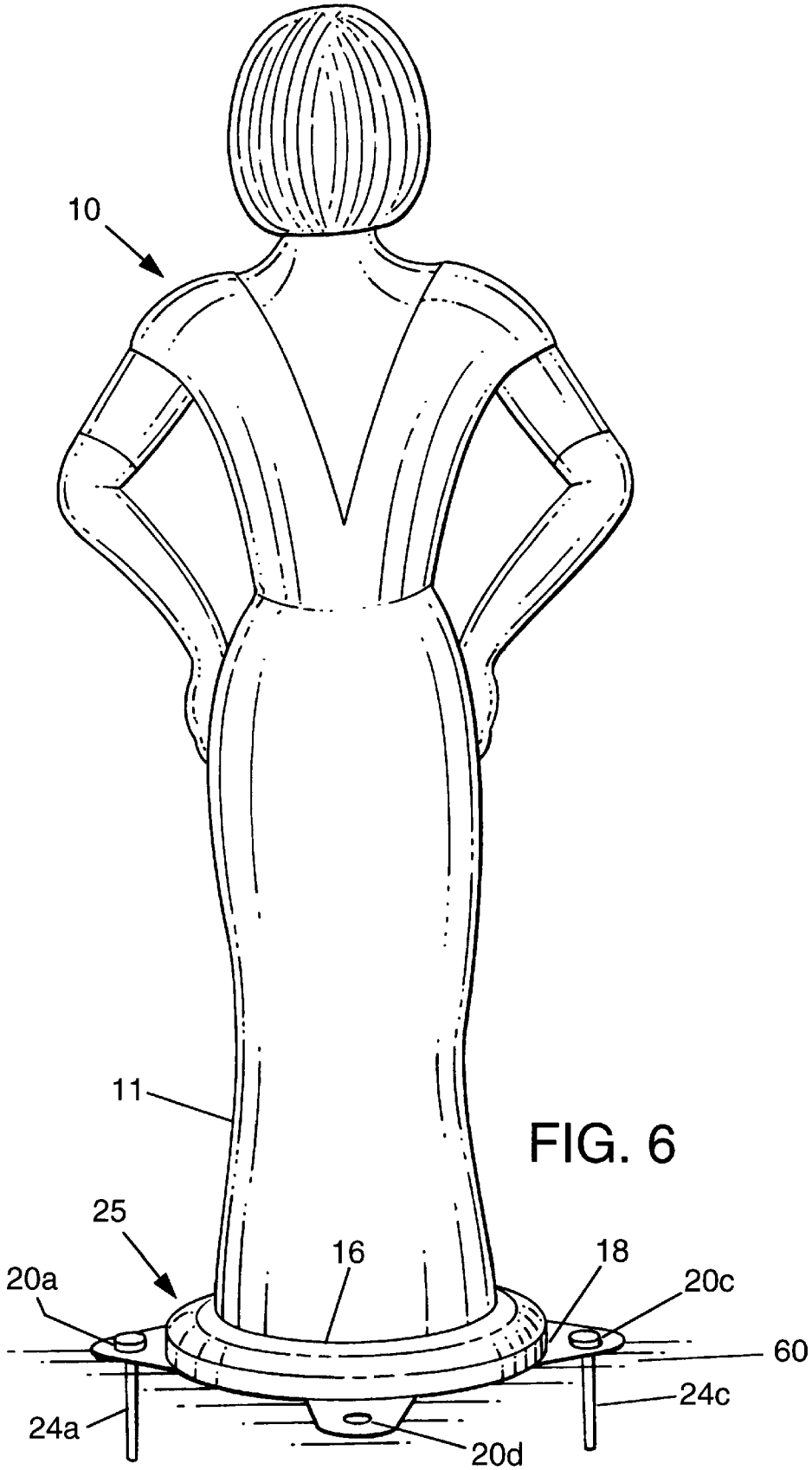
FIG. 6 is a rear elevational view of an inflatable indoor/outdoor display figure shown in FIG. 1.

The inflatable display 10 is made of substantially flexible sheet material such as a polymer material, vinyl or any other such material commonly used for making inflatable toys or rafts. Further, the material should be capable of being heat sealed. The bottom, inner and top layers 30, 32, 40 are heat sealed to form the base 25, and the base 25 is heat sealed to the upper inflatable portion 11 forming a seam 16. More specifically, the inner layer 32 and top layer 40 are heat sealed at point 17 as shown in FIG. 5. The heat sealing process is also used to enclose an interior volume 38 of the upper inflatable portion 11, causing the inflatable display 10 to become a semi-rigid structure, in this case a young lady. A valve 12 is disposed in the upper inflatable portion 11 for inflating the display 10 to provide it in an erect, self-supporting condition by pressurizing the interior volume 38.

Figure 8:
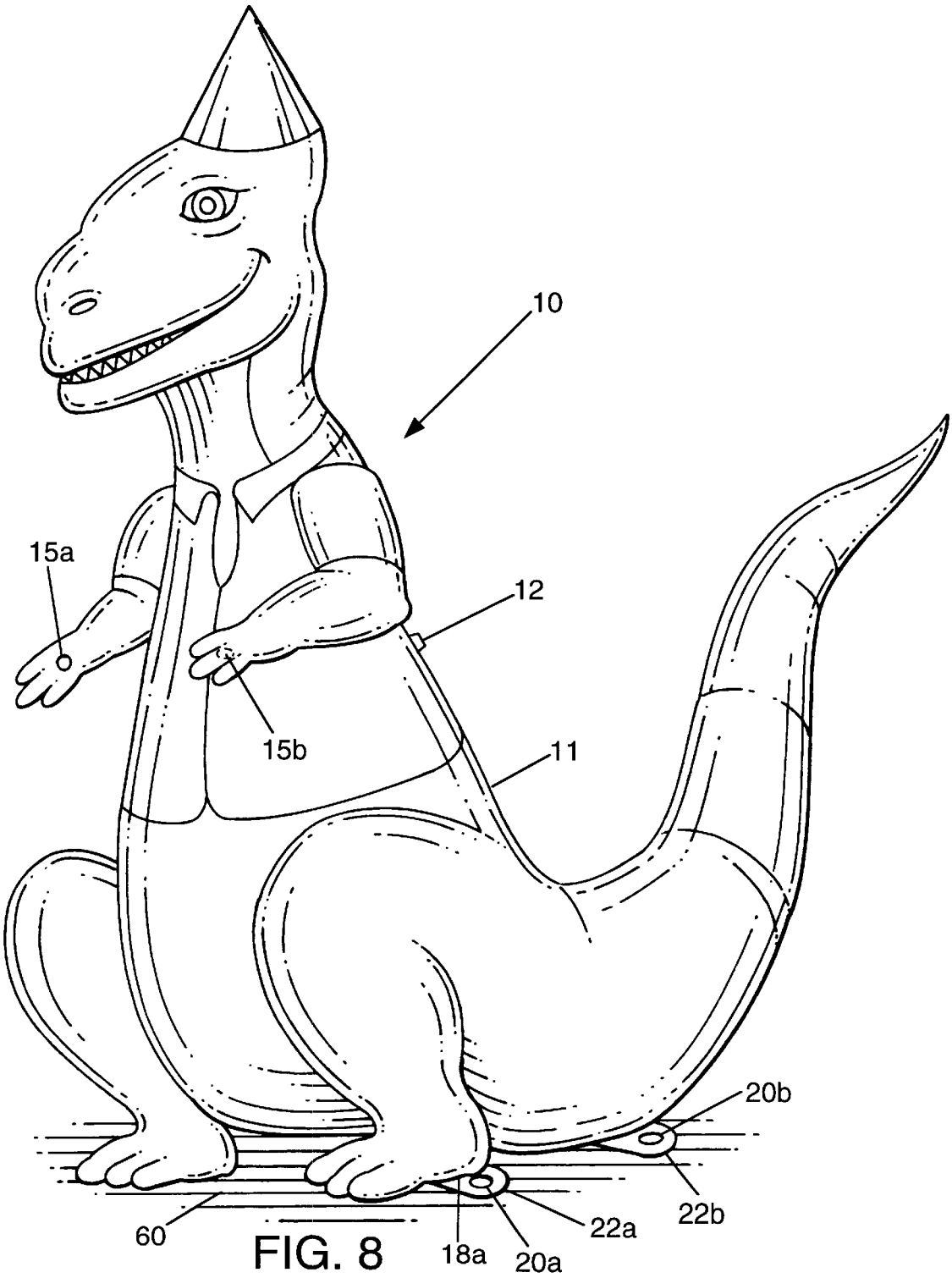
FIG. 8 is a perspective view of the display figure in FIG. 7.

Another feature of the invention is a message area 14 that is integrated within the upper inflatable portion 11. Messages can be personalized with a writing instrument such as a magic marker to make it more useful for consumers. Alternatively, the message area 14 may be independently removable from the upper inflatable portion 11 as shown in FIG. 8. In that embodiment the upper inflatable portion 11 would further comprise a plurality of fasteners 15*a,* 15*b,* such as but not limited to a snap or Velcro, for attaching the message area 14 thereto. The message area 14 may then have a pre-printed message on one side and be blank on the other side so that a personalized message could be written thereon. The consumer would have a choice of displaying the pre-printed message side or the blank side through use of the fasteners 15*a,* 15*b.*

The inflatable display 10 is made to be self-supporting on an outdoor or indoor surface 60 by means of its construction as shown in FIGS. 1–9. The inflatable display 10 is able to stand erect and balanced by means of the attached base 25, which has the inflatable base portion 26. The shape of the inflatable base portion 26 can be a ring, but it is not limited thereto. It may vary depending upon the design of the upper inflatable portion 11. For example, it may be in the shape of a square, rectangle or legs. The purpose of the inflatable base portion 26 is to give the inflatable display 10 better balance when it is not possible to fasten it into the support surface 60.

Figure 7:
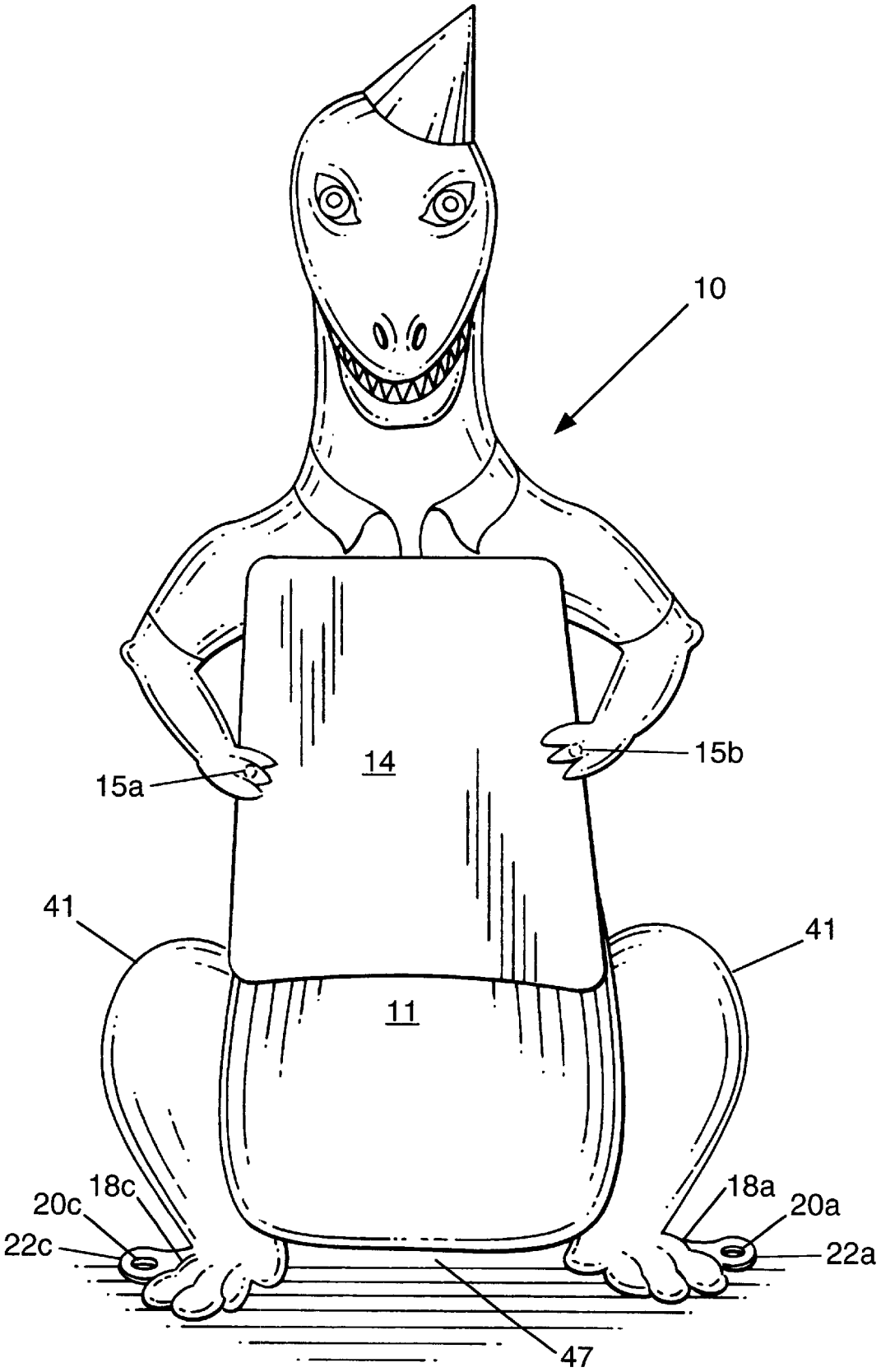
FIG. 7 is a front elevational view of another embodiment of the display figure in the shape of a dinosaur.
Figure 9:
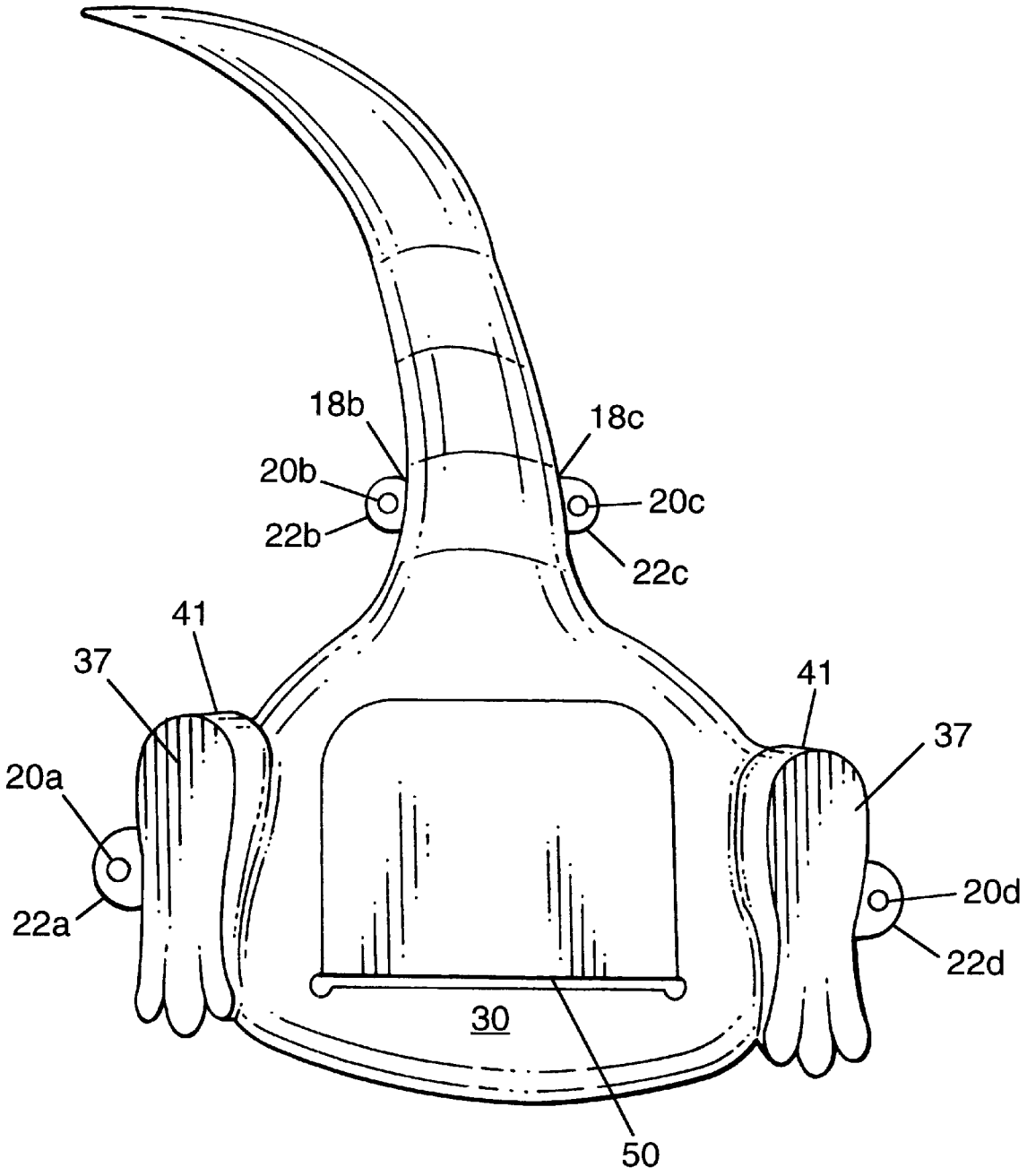
FIG. 9 is a bottom view of the display figure in FIG. 7.

The inflatable base portion 26 may also comprise a height adjustment mechanism 35 to increase the height of the pocket 50. The height adjustment mechanism 35 may take the form of an I-shape support 36 traversing between the top layer 40 and the topside 34 of the inner layer 32 of the base 25. Alternatively, as shown in FIGS. 7–9, the upper inflatable portion 11 may take a shape that has feet 37. The feet 37 would be of sufficient height such that the pocket 50 would be tall enough for placement of the weight 52 therein. The pocket 50 must have sufficient dimensions so that the weight 52 can be positioned within the pocket 50 via the opening 28 of the bottom layer 30 of the inflatable display FIG. 10. The weight 52 does not need to be completely enclosed within the pocket 50.

The base 25 perimeter has a plurality of tabs 22*a,b,c,d* attached thereto. Although the embodiments shown in FIGS. 1–9 have four such tabs, this amount may differ depending upon the design of the inflatable display 10. A heat sealed seam 18 about the base 25 perimeter inhibits air from inflating these tabs 22. Each tab 22 contains a reinforced opening 20 that permits a mounting fastener 24 to pass therethrough to the support surface 60.

Another aspect of the present invention is an equalizing air hole 48 defined within the upper inflatable portion 11. The equalizing air hole 48 is positioned such that the upper inflatable portion 11 and the inflatable base portion 26 can be inflated substantially simultaneously and pressure therein can remain substantially in equilibrium.

Viewing FIGS. 7–9, another embodiment of the present invention is shown in the shape of a dinosaur with legs 41 and feet 37. The base 25 in this embodiment is simpler in construction because the pocket 50 is formed by heat sealing the bottom layer 30 to the bottom of the upper inflatable portion 11. As previously stated, the legs 41 and feet 37 serve as the height adjustment mechanism 35 to deepen the pocket 50 for placement of the weight 52 therein.

To use the inflatable display 10, a gas such as air is forced through the valve 12 to pressurize the interior volume 38. As the upper inflatable portion 11 is pressurized, air passes through the equalizing air hole 48 to the inflatable base portion 26 of the base 25. As the display 10 inflates, the upper inflatable portion 11 rises to increase the height of the pocket 50. The height of the pocket 50 will depend on the type of height adjustment mechanism 35 utilized. Once inflation is completed, the weight 52 can be placed in the pocket 50 via the opening 28 so that the inflatable display 10 remains substantially stationary. Also, a personal message can be written on the message area 14.

Conventional signs have been rather dull and expensive for the needs of the general public. These signs are mainly one-dimensional and limited in size. This invention could be made in an endless variety of exciting three-dimensional forms that could appeal to children and adults. Each display could have a message area 14 that can be personalized for the consumer. With this new and novel construction, the consumer is able to use this inflatable display 10 indoors and outdoors. It will be balanced to stand erect, eliminating the unbalanced effect that other inflatable display figures have shown. It should cost the consumer less than other related art displays since the consumer will not have to pay for the added cost of manufacturing it with a weighted bottom. This should also greatly reduce shipping costs. Also, by eliminating the hardboard in its base, packaging will be much smaller and appealing to both consumers and retailers alike.

Although the present invention has been described in considerable detail with reference to certain preferred versions thereof, other versions are possible. Therefore, the spirit and scope of the appended claims should not be limited to the description of the preferred versions contained herein.

I claim:

1. An inflatable display, comprising:

an upper inflatable portion; and a folding base attached to said upper inflatable portion, said base being made of a non-rigid sheet material and having an inflatable base portion comprising a top layer and an inner layer being sealingly bonded together, and a pocket defined by the inner layer and a bottom layer, the pocket having a height that increases as the inflatable display is inflated, said bottom layer having an opening for a weight.

2. The inflatable display of claim 1, wherein said base further comprises a tab with a reinforced opening for permitting a fastener to pass therethrough to a support surface.

3. The inflatable display of claim 2, wherein said base is an inflatable ring.

4. The inflatable display of claim 2, wherein said base further comprises a height adjustment mechanism.

5. The inflatable display figure of claim 2, wherein said upper inflatable portion further comprises feet, said feet being a height adjustment mechanism for said pocket.

6. The inflatable display of claim 1, wherein said upper inflatable portion further comprises a hole such that the upper inflatable portion and said inflatable base portion can be inflated substantially simultaneously.

7. The inflatable display of claim 1, further comprising a message area integral with said upper inflatable portion.

8. The inflatable display of claim 1, further comprising a removable message area, said upper inflatable portion further comprising a fastener, said removable message area attaching to said upper inflatable portion by said fastener.

9. The inflatable display of claim 1, wherein said display is made of substantially flexible sheet material.

10. An inflatable display, comprising:

an upper inflatable portion; and a flexibly foldable base being made of sheet material, said base having a bottom layer, an inner layer and a top layer, the bottom layer including an opening, the inner layer having an underside and a topside, the top layer and the topside of the inner layer being sealingly bonded together defining an inflatable base portion to balance the display figure, and the bottom layer and the underside of the inner layer defining a pocket communicating with said opening, the pocket having a height and being shaped for positioning a weight therein when said upper portion and said inflatable base portion are inflated.

11. The inflatable display of claim 10, wherein said upper inflatable portion further comprises a message area.

12. The inflatable display of claim 10, wherein said bottom wall further defines an equalizing air hole such that the upper inflatable portion and said inflatable base portion can be inflated substantially simultaneously and pressure within said upper inflatable portion and said inflatable base portion remains substantially in equilibrium.

13. The inflatable display of claim 10, wherein said base is ring-shaped.

14. The inflatable display of claim 10, wherein said base further comprises a plurality of tabs with reinforced openings, each opening being shaped to permit a fastener to pass therethrough to a support surface, said tabs being uninflatable and attached to an outer edge of said base.

15. The inflatable display of claim 10, wherein the base further comprises a height adjustment mechanism for said pocket.

16. The inflatable display of claim 10, wherein upper inflatable portion is further comprises legs and feet, said legs and feet being of sufficient height such that said pocket has sufficient dimension for placement of the weight therein.

17. An inflatable display, comprising:

an upper inflatable portion;

a flexibly foldable base attached to said upper inflatable portion for supporting the weight thereof, said base being made of sheet material having an inflatable base portion comprising a top layer and an inner layer being sealingly bonded together;

a pocket formed by a bottom layer and said upper inflatable portion for positioning of a weight therein; and the pocket having a height that increases as the upper inflatable portion is inflated.

18. The inflatable display of claim 17, further comprising a fastener attached to said upper inflatable portion for fastening a detachable message area, said base further comprising at least two legs for supporting said upper inflatable portion, said legs being a height adjustment mechanism for increasing the height of said pocket.

19. A method for balancing an inflatable display on a support surface, comprising the steps of:

inflating said display with a gas, wherein said display has a flexible base being made of sheet material, said base being foldable having an inflatable base portion comprising a top layer and an inner layer being sealingly bonded together, and a pocket defined by the inner layer and a bottom layer, said bottom layer having an opening, said inflatable base portion being inflated substantially simultaneously with said display via an equalizing airhole;

increasing the height of said pocket as said display is inflated.

20. The method of claim 19 for balancing an inflatable display, further comprising the step of positioning a fastener through a tab having a reinforced uninflatable opening to said support surface, said tab being attached to said base.

21. The method of claim 19 for balancing an inflatable display, further comprising the step of positioning a weight in said pocket through said opening of said bottom layer.

* * * * *